US008246372B1

(12) United States Patent
Walters

(10) Patent No.: US 8,246,372 B1
(45) **Date of Patent: *Aug. 21, 2012**

(54) ELECTRICAL CONNECTOR WITH ANCHOR MOUNT

(75) Inventor: James C. Walters, Cresson, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 187 days.

This patent is subject to a terminal disclaimer.

(21) Appl. No.: 12/788,531

(22) Filed: May 27, 2010

(51) Int. Cl.
*H01R 13/62* (2006.01)

(52) U.S. Cl. ..... 439/310

(58) Field of Classification Search ..... 439/310, 439/311, 320
See application file for complete search history.

(56) References Cited

U.S. PATENT DOCUMENTS 1,188,568 A * 6/1916 Smith ..... 439/310
1,488,473 A * 4/1924 Brown ..... 213/1.3
2,703,870 A 3/1955 Minto
2,987,691 A 10/1958 Ross
3,217,211 A * 11/1965 Norden ..... 361/608
3,345,604 A * 10/1967 Henschen et al. ..... 439/310
3,529,276 A * 9/1970 Hennessey, Jr. ..... 439/310
3,605,069 A 9/1971 Dorrell
3,659,250 A 4/1972 Horton
3,848,950 A * 11/1974 McCormick et al. ..... 439/311
4,042,291 A * 8/1977 Moriyama ..... 439/210
4,083,619 A * 4/1978 McCormick et al. ..... 439/310
4,183,606 A * 1/1980 Kies ..... 439/345
RE31,462 E * 12/1983 McCormick et al. ..... 439/316
4,580,865 A 4/1986 Fryberger
4,624,472 A * 11/1986 Stuart et al. ..... 280/420
4,820,183 A * 4/1989 Knapp et al. ..... 439/310
4,852,516 A * 8/1989 Rubin et al. ..... 118/715
4,898,541 A * 2/1990 Lhuillier ..... 439/248
4,900,260 A 2/1990 Drogo
4,940,414 A * 7/1990 Lee ..... 439/131
4,984,993 A * 1/1991 Neumann et al. ..... 439/157
5,071,364 A * 12/1991 Bourgie ..... 439/296
5,106,321 A * 4/1992 Haroutel ..... 439/310
5,174,772 A * 12/1992 Vranish ..... 439/131
5,175,671 A * 12/1992 Sasaki ..... 361/679.43
5,182,698 A * 1/1993 Kobayashi et al. ..... 361/679.43
5,334,032 A 8/1994 Myers
5,484,296 A * 1/1996 Taylor ..... 439/140
5,504,991 A * 4/1996 Parmley, Sr. ..... 29/825
5,507,660 A * 4/1996 Jalliffier ..... 439/197
5,529,510 A * 6/1996 Wakata et al. ..... 439/310
5,584,724 A * 12/1996 Shibata et al. ..... 439/507
5,633,782 A * 5/1997 Goodman et al. ..... 361/679.41
5,743,755 A * 4/1998 Aoki ..... 439/354
(Continued)

*Primary Examiner* — Neil Abrams
(74) *Attorney, Agent, or Firm* — Morani Patent Law, PC

(57) ABSTRACT

An anchored 522 male electrical connector is provided. A stationary housing 520 is combined with a coupling ring 540 to form an outer housing. An internal plunger 560 is housed in and spans the length of the outer housing. The stationary housing 520 mounts onto an anchoring surface via an anchor mount 522, while the coupling ring 540 is free to rotate about the internal plunger 560. The coupling ring is rotated via a hand grasp 441. The coupling ring rotation 442, 443 translates into forward and aft movement of the pin assembly 515. The connector provides forward 520-1 and backward stops 520-4 for limiting pin insertion and extraction moves to desired distances. Rotation via triple start threads 548, 525 readily overcomes insertion and extraction resistance of a bulky multi-pin assembly 515 and provides a smooth and controlled electrical connection. The connector may be sized to meet multi-pin connector needs or military standards.

17 Claims, 10 Drawing Sheets

U.S. PATENT DOCUMENTS 5,777,480 A * 7/1998 Hatagishi et al. ..... 324/538
5,864,294 A * 1/1999 Hsu et al. ..... 340/635
6,126,469 A * 10/2000 Yamaguchi ..... 439/310
6,275,385 B1 * 8/2001 Sahara et al. ..... 361/752
6,356,053 B1 * 3/2002 Sandoz et al. ..... 320/115
6,358,078 B1 3/2002 Crippa
6,418,027 B1 * 7/2002 Suzuki et al. ..... 361/729
6,520,792 B2 * 2/2003 Chen-Chiang et al. ..... 439/373
6,550,977 B2 * 4/2003 Hizuka ..... 385/55
6,625,014 B1 * 9/2003 Tucker et al. ..... 361/679.34
6,660,950 B2 * 12/2003 Fonseca ..... 200/51 R
7,124,505 B2 * 10/2006 Friesen et al. ..... 29/876
7,645,162 B2 * 1/2010 Kadar-Kallen et al. ..... 439/578
7,931,486 B1 * 4/2011 Walters ..... 439/320

* cited by examiner

ELECTRICAL CONNECTOR WITH ANCHOR MOUNT

BACKGROUND OF THE INVENTION

The present invention relates generally to electrical connectors and more particularly to a male multi-pin connector device and method of providing repeatable consistent connection with a female receptacle connector.

Making electrical contact across multiple pins for continuity across industrial cables can be accomplished with a variety of conventional connectors to include military standard connectors such as a D38999 series connector. Within military applications and in industry environments there are a multitude of applications where fine control over multiple contact pin engagements into contact pin receptacles is desirable.

Plug-type connectors connected to testing circuitry may be repeatedly connected and disconnected to test a given device periodically and/or to test a number of devices. For example, testing of missile launch circuitry may be desired at periodic intervals. Testing of other aircraft circuitry or a launch connector may be desirable as well. It would be desirable if multiple connecting and disconnecting operations could be done without damaging either the connector which is connected to the launch circuitry or the tester connector. A means of verification of pin and receptacle mating between the female connector and the male tester connector is also desirable.

Conventional male plug-type connectors with conventional female-socket-type connectors can be difficult to connect and disconnect in on-site applications. Ease of use of a connector is also desirable for test connectors to be used in areas of restricted accessibility, reach, and visibility. Conventional connectors may comprise a large lever or handle for a means of inserting and extracting pins in a connector. In certain applications, such as testing aircraft circuitry for an air-intercept missile 120 (AIM-120) launcher rail, a means of assessing contact pin position, other than electrical measurements, may not be possible. Conventional levers to establish electrical connection and disconnection may create an undesirable off axis moment about the connector. This can lead to stress, loosening, and bending of the connector pins.

It would be desirable to have a connector which did not induce undesirable physical forces on the electrical contact pins. Limiting an applied force upon the connector during mechanical mating may also be desired, contributing to a long usable service life of the connector. Applications with multi-pin connections or heavy cables can exacerbate these challenges. Applications not within easy reach of the user can add to the challenges of providing finely controlled and reliable connections and disconnections.

SUMMARY OF THE INVENTION

The present invention addresses some of the issues presented above by providing a method and device for displacing a set of connector pins with a controlled on axis force and a stop catch upon full pin insertion and full pin extraction, while providing device reliability. Aspects of the present invention are provided for summary purposes and are not intended to be all inclusive or exclusive. Embodiments of the present invention may have any of the aspects below.

One aspect of the present invention is to ensure electrical connection by providing full pin insertion into the female socket.

Another aspect of the present invention is to minimize any moment on the pins by using balanced on axis motion to displace the pin plunger.

Another aspect of the present invention is to provide fine manual control of pin displacement during insertion and extraction from the female receptacle.

Another aspect of the present invention is to use alignment pins to ensure alignment of the desired pin configuration with the female plug.

Another aspect of the present invention is a connector which provides an affirmative forward stop for complete pin insertion and maximum pin displacement. Yet another aspect of the present invention is a connector which provides an affirmative stop for full pin retraction for both ease of use and safety.

Another aspect of the present invention is compatibility with conventional female military connectors as well as conventional female socket-type connectors.

Another aspect of the present invention is its ease of assembly and disassembly.

Another aspect of an exemplary embodiment of the present invention may be its relative ease of use in connecting to and testing of a circuitry for a missile launcher rail.

Another aspect of the present invention is its ready insertion into a missile launcher rail, in accordance with an exemplary launcher rail mount embodiment.

Another aspect of the present invention is its compatibility with a multitude of anchoring surfaces, in accordance with an exemplary anchor mount embodiment.

Another aspect of the present invention is its use of an anchored stationary housing, which contributes to the ease of use, fine control of electrical connection, device longevity, and safety.

Another aspect of the present invention is its use of an anchored stationary housing in combination a rotatable coupling ring with triple start threads to provide leverage and control of pin displacement.

Another aspect of the present invention may be the ability to prevent excess force from being applied to any mechanical mating, such as contact pin engagement via torque limiting means in a coupling ring.

Another aspect of an the present invention may be the ability to reach a minimum torque load before mechanical engagement of, for example, contact pins with receptacles occurs. This aspect may be particularly desirable for connections in high vibration conditions.

Another aspect of the present invention may be the use of threads for axial pin plunger displacement in combination with exterior markings across the coupling ring and stationary housing can provide visual verification of contact pin position relative to female receptacles.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Parallel numbers across figures typically refer to like elements for ease of reference. Reference numbers may also be unique to a respective figure or embodiment and need not be consistent across figures.

Figure 1:
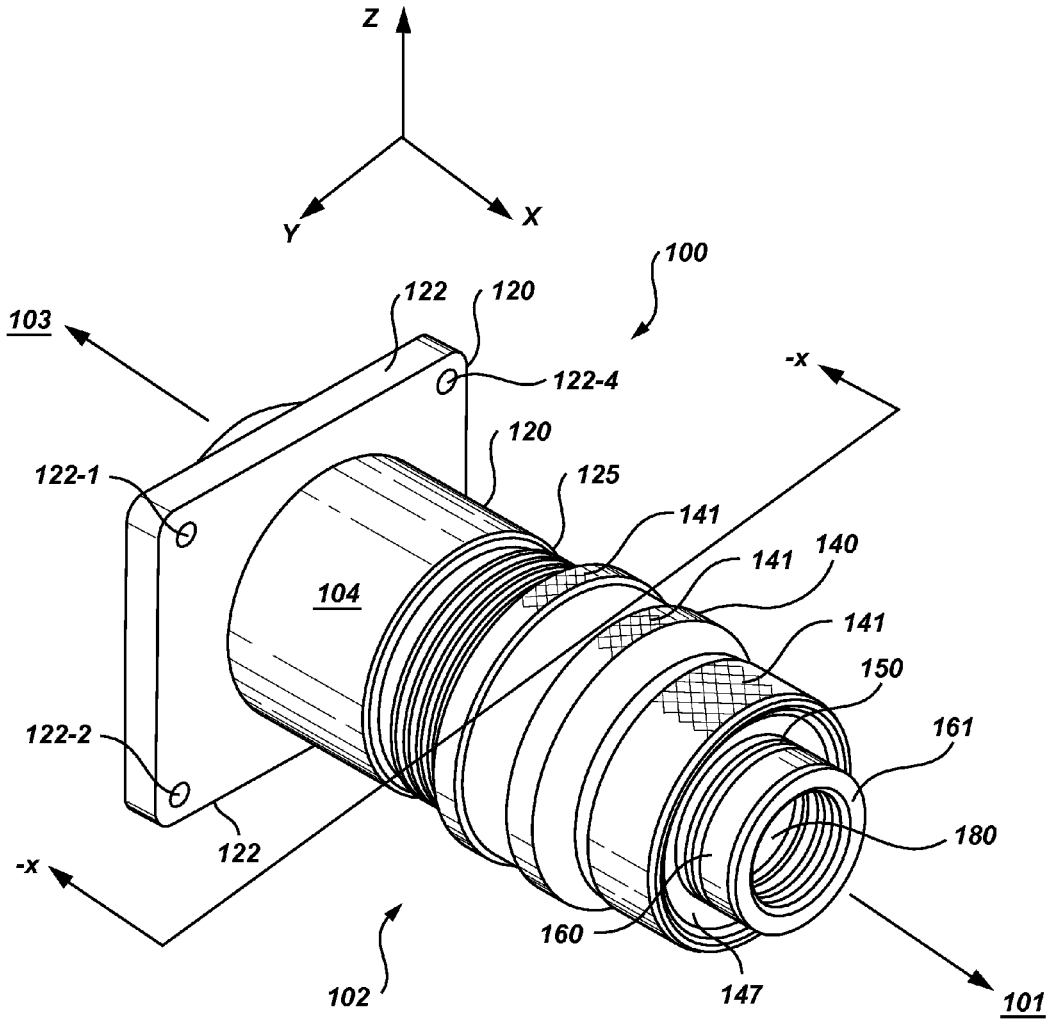
FIG. 1 shows a back perspective view of a connector in accordance with an embodiment of the present invention.

FIG. 1 shows a back perspective view of a connector in accordance with an embodiment of the present invention. The stationary housing 120 forms the front half of the connector, where the front end 103 connects to a female connector. An internal plunger 160 extends out the back end 101 of the connector. In the perspective view of FIG. 1, a left side 102 of the connector is in the foreground. The stationary housing 120 comprises an anchor mount 122. Four through holes in the anchor mount are used for securing the stationary housing 120 to an anchoring surface, surface not show. Three of these four through holes are shown in each corner 122-4, 122-1, 122-2. A portion of the threads of the stationary housing 125 are shown next to an edge of the coupling ring 140. A rear washer 147 and a snap ring 150 are visible from an opening in the coupling ring 140 facing the back end 101. The snap ring 150 is secured around the plunger 160. A desired cable extends into the plunger 160 through opening 180. Reference 104 indicates a top side surface of a connector. A rough or grooved surface 141 is shown in the coupling ring 140 for gripping the coupling ring and for a tactile or visual reference of coupling ring position. In practice, the anchor mount may be secured to an anchoring surface with suitable fasteners, to include, for example, four screws.

Figure 2:
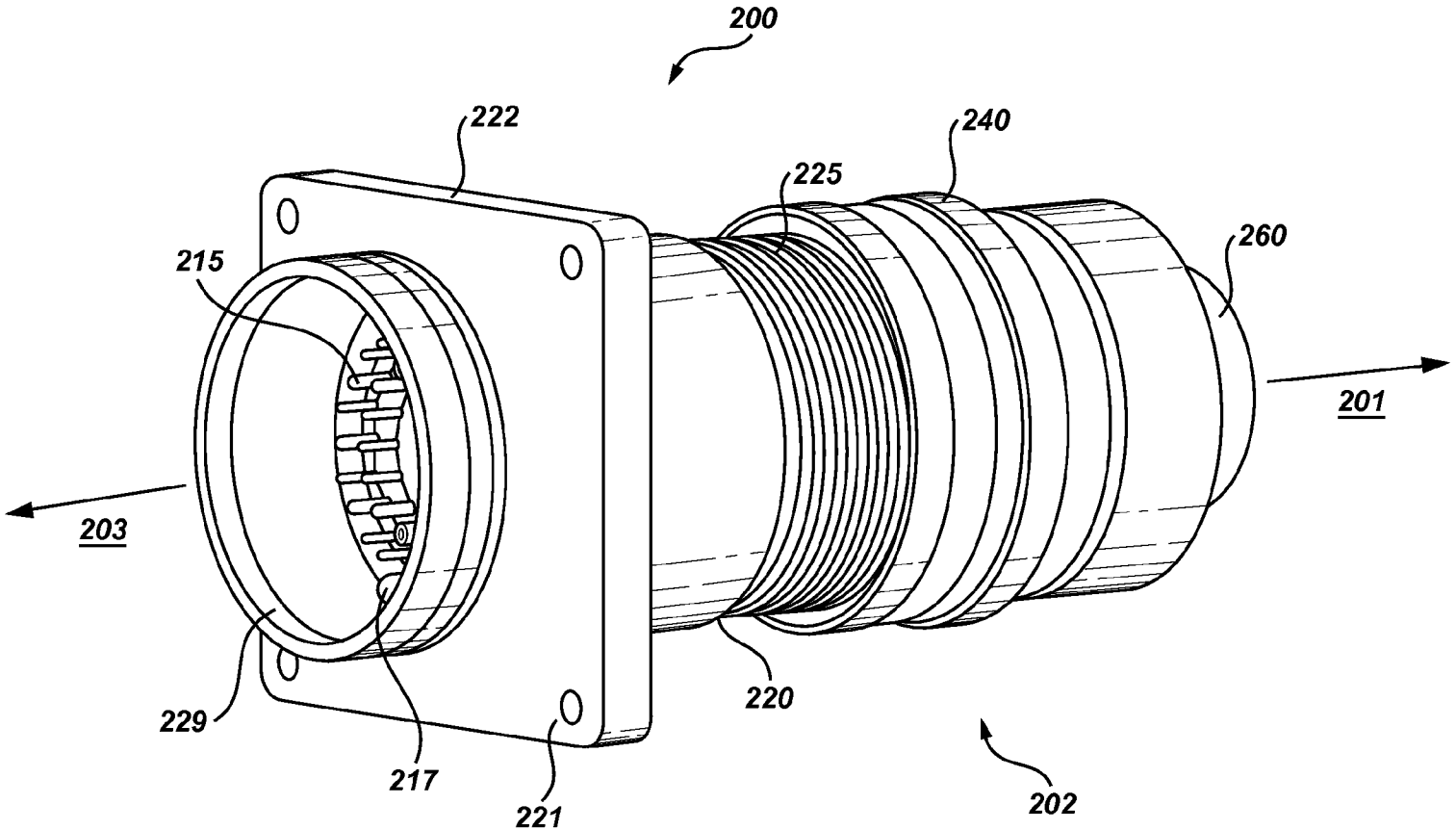
FIG. 2 shows a front perspective view of a connector in accordance with an embodiment of the present invention.

FIG. 2 shows a front perspective view of a connector in accordance with an embodiment of the present invention. The coupling end 229 of the stationary housing 220 forms the front 203 portion of the connector, which mechanically connects to a female connector. An internal plunger 260 extends out an opening in the coupling ring 240 towards the back end 201 of the connector. In the perspective view of FIG. 2, the anchor surface side 221 of the anchor mount 222 is visible. In practice, the anchor surface side 221 of the anchor mount 222 will face the anchoring surface. An exemplary anchoring surface is shown in FIG. 3 Referring to FIG. 2, a portion of the threads of the stationary housing 225 are shown next to an edge of the coupling ring 240.

Figure 3:
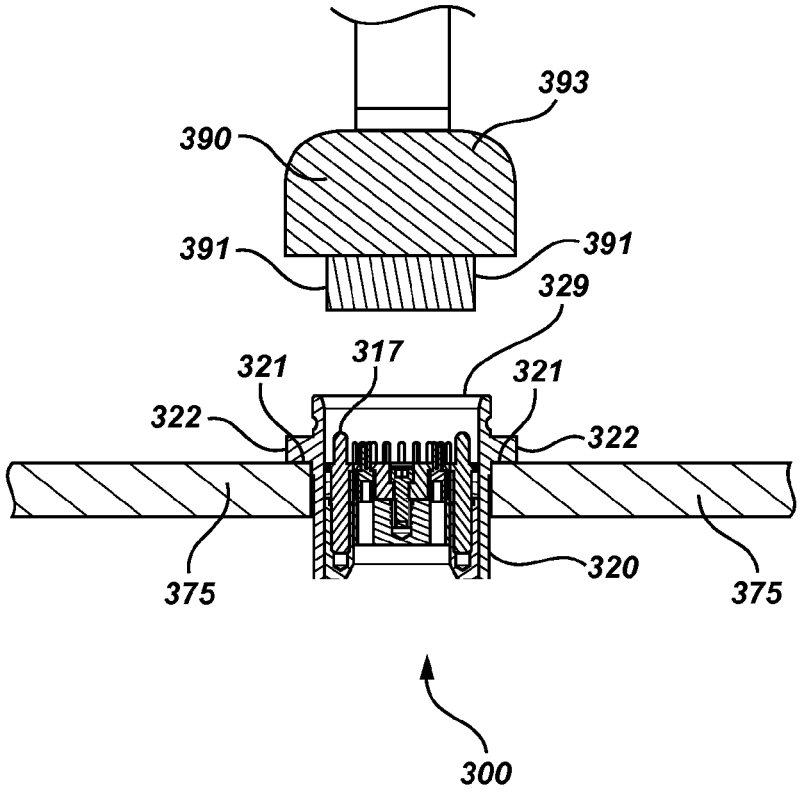
FIG. 3 shows cross section of a block diagram of an exemplary connector in accordance with an embodiment of the present invention, which is secured to an anchoring surface.
Figure 11:
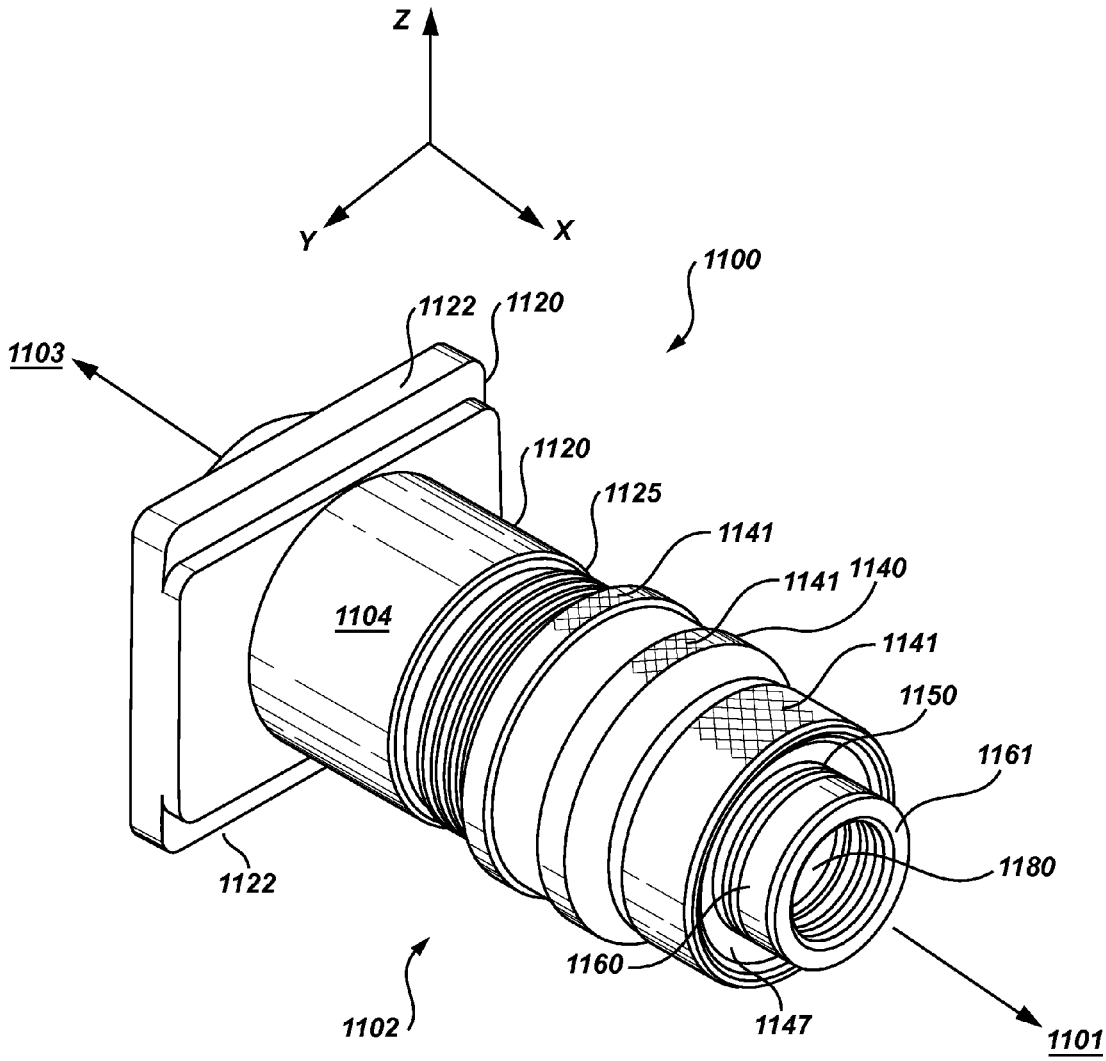
FIG. 11 shows an exemplary embodiment of the present invention with a missile launch rail.

FIG. 3 shows cross section of a block diagram of an exemplary connector in accordance with an embodiment of the present invention, which is secured to an anchoring surface. The anchor mount 322 is secured to the anchoring surface 375 to hold the stationary housing 320 stationary. The coupling end 329 of the stationary housing 320 is exposed for receipt of a female connector 390. An anchoring surface, for example a wall, 375 is shown for illustrative purposes and alternate anchoring surfaces may be utilized with the anchor mount of the present invention. Alternate means of grasping or securing the anchor mount 322 to the anchoring surface 375, while exposing an opening for access to the coupling end 329 of the stationary housing 320, are compatible with exemplary embodiments of the present invention. Alternate embodiments of the present invention may have a different anchor mount configuration 322 to fit into a desired anchor frame. Exemplary embodiments of the present invention are compatible with multiple conventional missile launch rails, described below in reference to FIG. 11. Referring to FIG. 3, connector 390 may itself be tested or the connector may provide a connection for testing of associated launch circuitry. Connector plug 391 extends out from the female connector housing 393 for insertion into the coupling end 329 of the stationary housing. Additional details of the internal plunger and stationary housing are not shown in FIG. 3.

Figure 4:
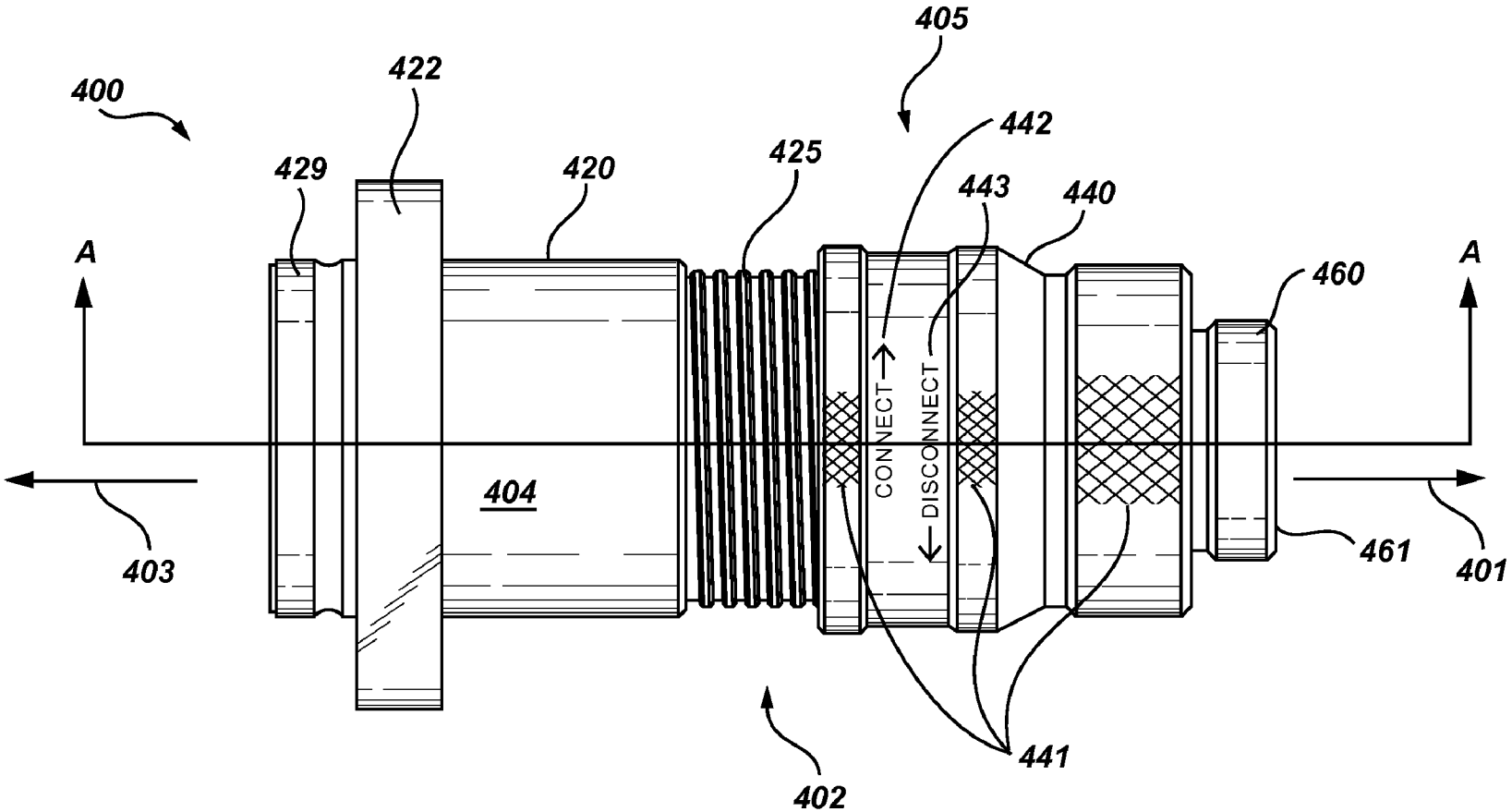
FIG. 4 shows a top view of connector in accordance with an exemplary embodiment of the present invention.

FIG. 4 shows a top view of a connector in accordance with an exemplary embodiment of the present invention. The asymmetry of the anchor mount 422 from left 402 to right 405 sides can be seen from the top 404 view. The configuration of the anchor mount 422 may vary across embodiments to accommodate different future and conventional launcher rails. The coupling end 429 faces the front 403 while the plunger 460 extends out of the coupling ring 440 towards the back 401 of the connector. Rough or grooved surfaces 441 are shown on the coupling ring 440 for gripping the coupling ring and for a tactile or visual reference of coupling ring position. In addition, FIG. 4 shows direction indicators 442, 443 for connecting and disconnecting the connector 400 from a female connector. Threads 425 on the stationary housing 420 are visible.

Figure 5A:
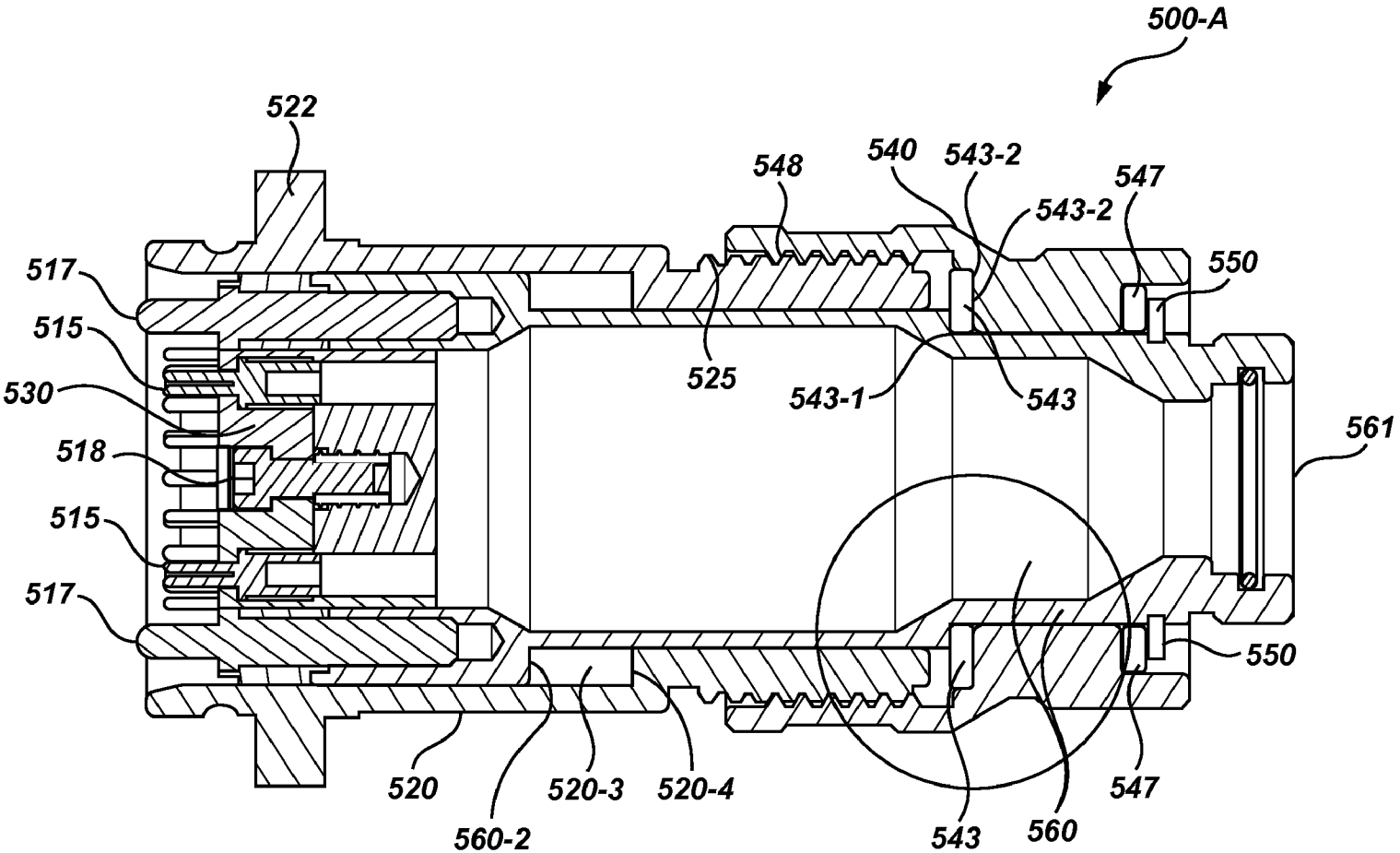
FIGS. 5A and 5B show cross sections of a connector along line A-A of FIG. 4, in accordance with an embodiment of the present invention, with the internal plunger in forward and aft positions, respectively.
Figure 5B:
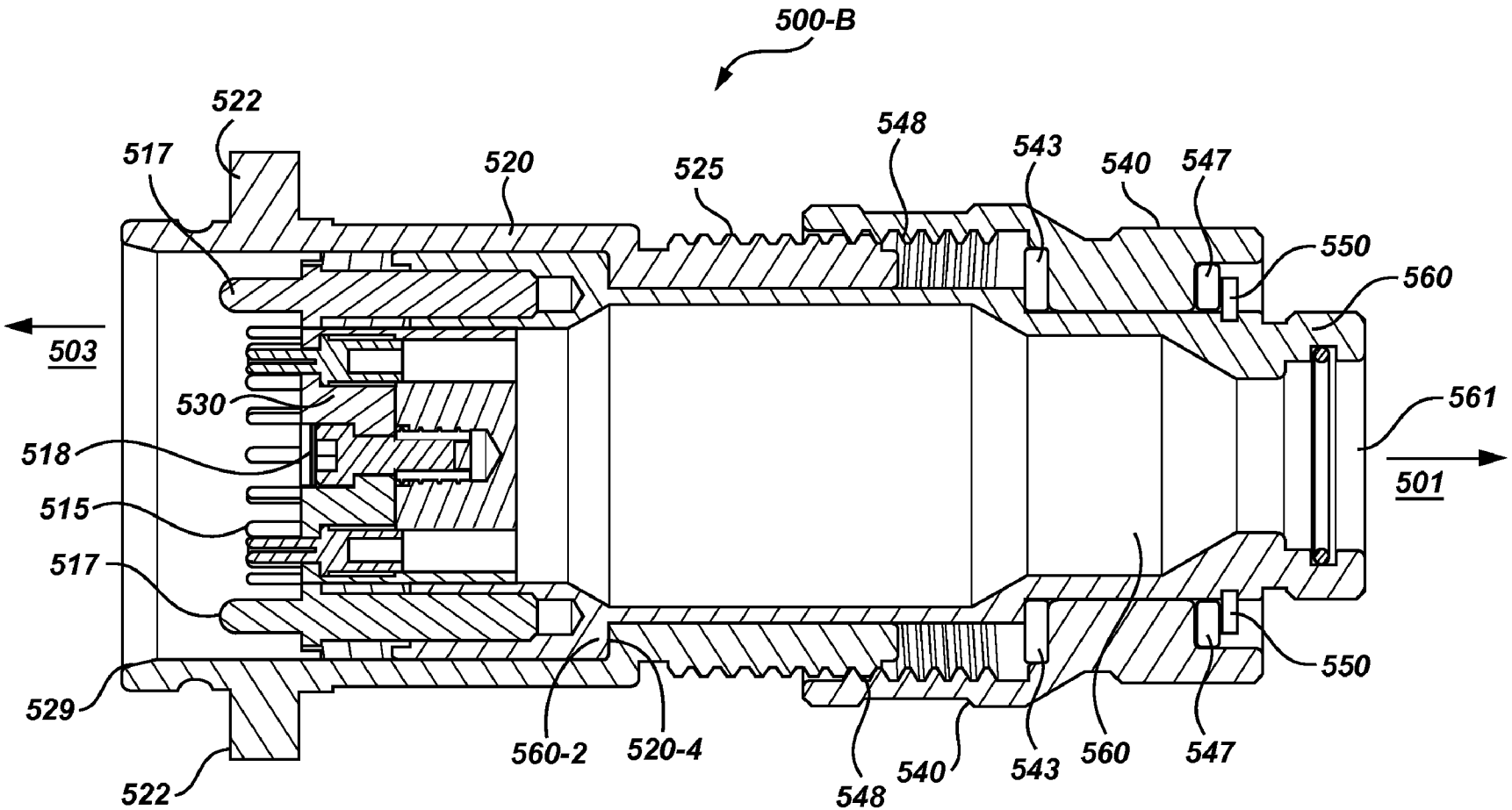

FIGS. 5A and 5B show cross sections of a connector along line A-A of FIG. 4, in accordance with an embodiment of the present invention, with the internal plunger in forward and aft positions, respectively. Turning first to FIG. 5B, showing the internal plunger 560 in the aft or rear position relative to the stationary housing 520. Alignment pins 517 extend toward the front 503 beyond the pin contacts 515. The coupling end 529 of the stationary housing 520 extends beyond the insertion points of the alignment pins 517. Alignment pins 517 extend forward past the contact pins 515. The collection of pins are mounted in a pin plug 530 and a center screw 518 is coupling the pin plug 530 to the internal plunger 560. Center screw 518 is recessed and contributes to the ease of assembling embodiments of the present invention. Contact pins 515 with pin plug 530 and alignment pins 517 are secured to the internal plunger 560 and move as a unit.

Towards the back end 501 of the connector, a snap ring 550 clamps around an outer circumference of an internal plunger 560. A rear washer 547 is positioned just forward of the snap ring and just aft of an edge of the coupling ring 540. As also shown in FIG. 1, a rear end 101 of the coupling ring 140 is open exposing the snap ring 150 and rear washer 147. Returning to FIG. 5B and moving still forward along the length of the connector 500-B, the coupling ring's 540 inner surface comes up along side an outer surface of the internal plunger 560 just forward of the rear washer 547 and continues to follow the outer surface of the internal plunger closely until the front washer 543 is reached. The outer diameter of the internal plunger is constant from the rear end 561 till just forward of the front washer 543. Just front of the forward washer 543, the internal plunger outer diameter steps outward coming close to an inner diameter of the stationary housing 520 and forming a small ledge upon which the front washer 543 makes contact. This section is also shown in FIG. 5A and in greater detail in FIG. 5C.

Referring again to FIG. 5B, the stationary housing 520 comprises external threads 525 on its back end 501. Just forward of the threads 525, the stationary housing 520 steps out to a larger inner and outer diameter. The outer diameter of the internal plunger steps out 560-2 filling in the step increase in stationary housing inner diameter 520-4. Moving forward, the stationary housing 520 expands to a non-circular shaft to form the anchor mount 522. And finally, the stationary housing narrows and becomes circular again to form its coupling end 529 on the front end 503 of the connector. In accordance with an exemplary embodiment, the coupling end of the stationary housing has a quick connect and disconnect form and may include an o ring, not shown.

In this cross sectional view, internal threads 548 of the coupling ring 540 can be seen both engaging external threads 525 and open to the interior of the coupling ring 540. In accordance with an embodiment of the present invention, external stationary housing threads 525 and internal coupling ring threads are triple start threads, providing fine control of pin translation in a heavy and large connector.

FIG. 5A shows the internal plunger 560 moved forward 503 relative to the stationary housing 520. The alignment pins 517 now extend past the coupling end 529 of the stationary housing 520. In the embodiment of FIG. 5A, pins 515 are pushed forward to the front 503 edge of the coupling end 529. As described above, alignment pins 517 and the pin assembly 515 are connected to the internal plunger 560 and move with the internal plunger.

As the coupling ring 540 turns clock wise, front washer 543 presses on a step of the internal plunger 560 and the plunger moves forward relative to the stationary housing 520. The threads of the coupling ring 548 engage more of the stationary housing external threads 525 and fewer open internal threads, or none as shown, are visible. As the plunger 560 slides forward in the stationary housing 520, a void 520-3 is created between an inner diameter of the stationary housing 520 and an outer diameter of the internal plunger 560.

Figure 5C:
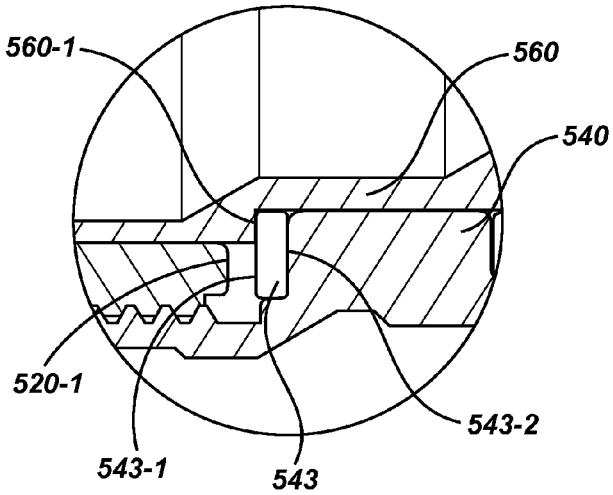
FIG. 5C shows an enlargement of a washer section in FIG. 5A in greater detail, in accordance with an exemplary embodiment of the present invention.

FIG. 5C shows an enlargement of a front washer section in FIG. 5A. Coupling ring 540 steps out in diameter forming an edge against which a rear side of the front washer 543-2 rests. An inner portion of front washer 543 rests on an outward step 560-1 of the internal plunger 560. The front face 543-1 of the front washer 543 rests on face 560-1 and may, in accordance with an exemplary embodiment, contact an aft end 520-1 of the stationary housing when the pin assembly 515 and internal plunger 560 are moved fully forward 503. Therein, the aftmost end 520-1 of housing 520 serves as a forward stop.

Figure 6:
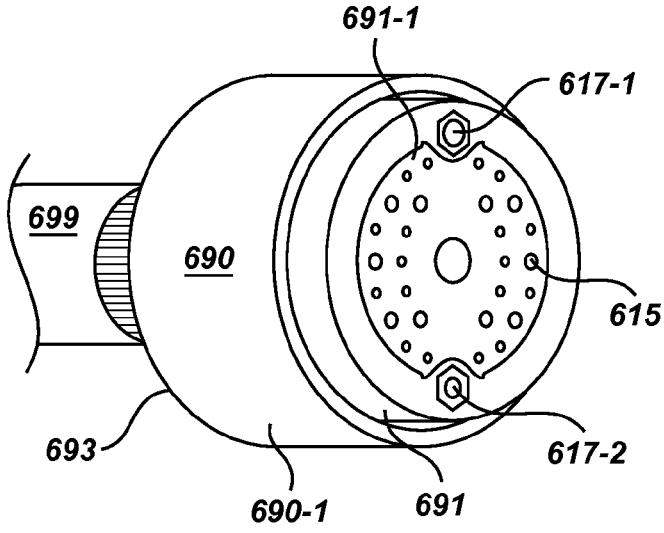
FIG. 6 shows a female connector compatible with a connector embodiment of the present invention.

FIG. 6 shows a female connector 693 compatible with an exemplary connector embodiment of the present invention. FIG. 6 shows an exemplary configuration of an insert or pin receptacle assembly 615 and a plug surface 691-1. In the female connector 693, receptacles for aligning pins 617-1 and 617-2 are 180 degrees apart and have different diameters to ensure proper orientation of the contact pin assembly with respect to the pin receptacle assembly. A female receptacle plug housing 691 extends beyond housing 690 for ready insertion into the opening of the coupling end 229, as shown in FIG. 2. Female receptacle plug housing 691, FIG. 6, encircles the plug 691-1 as well as the alignment pin receptacles 617-1, 617-2 but does not extend past the surface 691-1 which makes contact with the male connector, as shown. In accordance with exemplary embodiments of the present invention, the pin receptacle assembly 615, the plug surface 691-1 and its housing 691 insert into the connector opening 529, FIG. 5B. Contact pin and contact receptacle configurations or patterns are provided as examples for illustrative purposes.

In alternate embodiments, the diameter of, number of, and arrangement of the pin receptacles may vary as needed to accommodate varying pin contact diameters of a connector, in accordance with the present invention. Multiple receptacle configurations may be compatible with a same contact pin configuration. Actual pin number, size, and arrangement may vary in accordance with respective launcher rail requirements. A female connector 693 may not have housing 690, and may only have a housing 691, FIG. 6, which inserts into opening 529, FIG. 5B, in accordance with an exemplary embodiment of the present invention.

Figure 7:
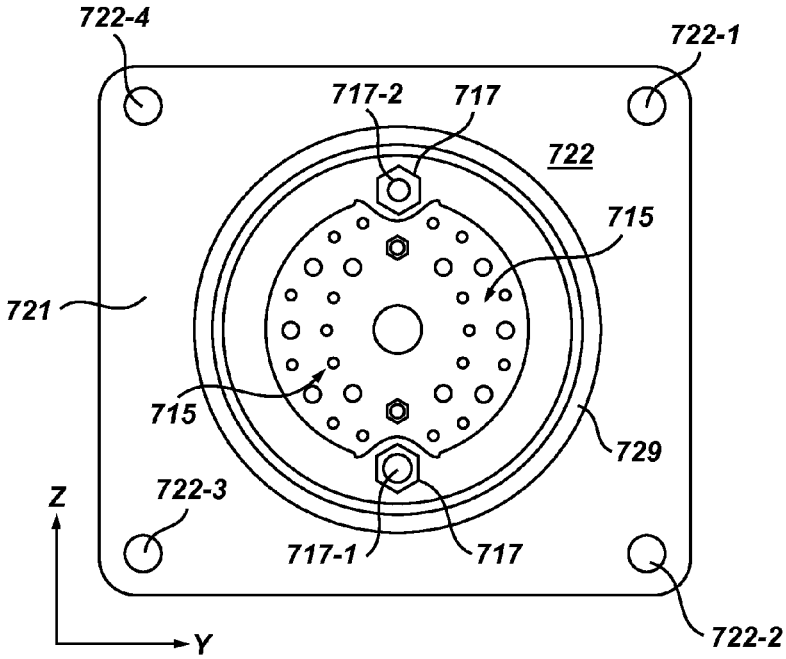
FIG. 7 shows a front view of a connector, in accordance with an exemplary embodiment of the present invention.

FIG. 7 shows a front view of a connector, in accordance with an exemplary embodiment of the present invention. The symmetry of the anchor mount 722 is shown in the Z and Y directions. The front face 721 of the stationary housing's anchor mount 722 faces into the anchoring wall, not shown. Through holes 722-1, 722-2, 722-3, 722-4 are shown in each corner. The anchor mount can be secured with, for example, bolts into an anchoring surface with corresponding threaded holes. In such an application, a connector in accordance with an embodiment of the present invention, could remain in place, while a number of female connectors and circuits to be tested are brought to the anchored connector. In accordance with alternate embodiments of the present invention, the anchor mount 722 may have alternate configurations to accommodate mounting in an alternate anchoring device or alternate anchoring surface.

In accordance with exemplary embodiments alignment pins 717-1, 717-2 and contact pins 715 are attached to the internal plunger. A shoulder 717, FIG. 7, of the alignment pins may rest on a surface 691-1 of the female plug, FIG. 6, when the female connector is connected to the connector 500-A, FIG. 5A, and the internal plunger 560 is in its full forward position 503. In accordance with an exemplary embodiment of the present invention, an outer shell 690-1 of the female connector 690 may circumscribe the outer diameter 729, FIG. 7, when the female connector 690 and its plug 691, FIG. 6, are inserted into the coupling end 729, FIG. 7, of the stationary housing.

The connecting cable 699 of the female connector 690, shown in FIG. 6, connects to the circuitry desired to be tested. Referring to FIG. 1, the cable connecting the pins 715, FIG. 7, to the desired tester exits the connector 100, FIG. 1, via opening 180 of the internal plunger 160 in the back end 101 of a connector in accordance with an exemplary embodiment of the present invention.

Figure 8:
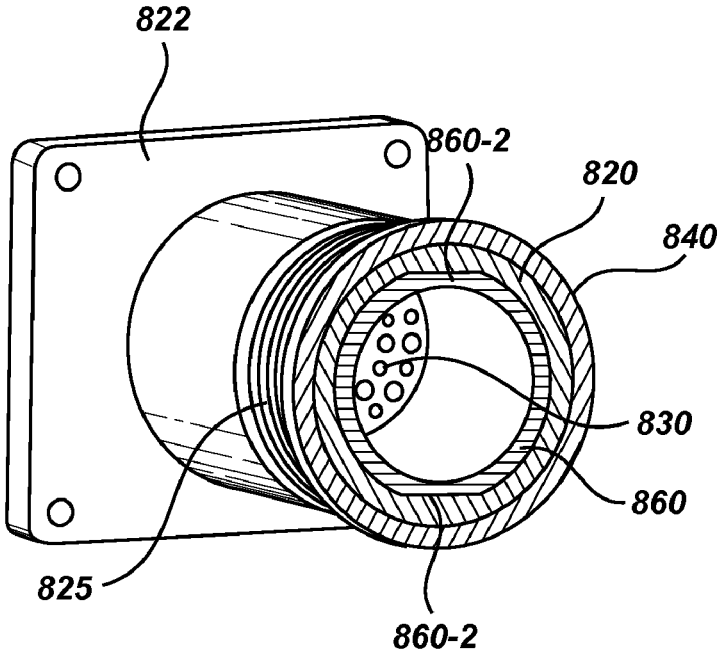
FIG. 8 shows a cross sectional view of an embodiment of a connector along line XX of FIG. 1, in accordance with an embodiment of the present invention.

FIG. 8 shows a cross sectional view of an embodiment of a connector along line XX of FIG. 1, in accordance with an embodiment of the present invention. At this cross section, flat portions 860-2 of the internal plunger 860 are visible. The outer surface of the stationary housing 820 and interior surface of the coupling ring 840 remain circular and are in threaded contact. FIG. 8 also shows the anchor mount 822 and threads 825 of the stationary housing 820. The flat portions 860-2 of the internal plunger are positioned 180 degrees across from each other and assist in preventing rotation of the plunger 860 as the coupling ring 860 is rotated about the stationary housing 820.

Figure 9A:
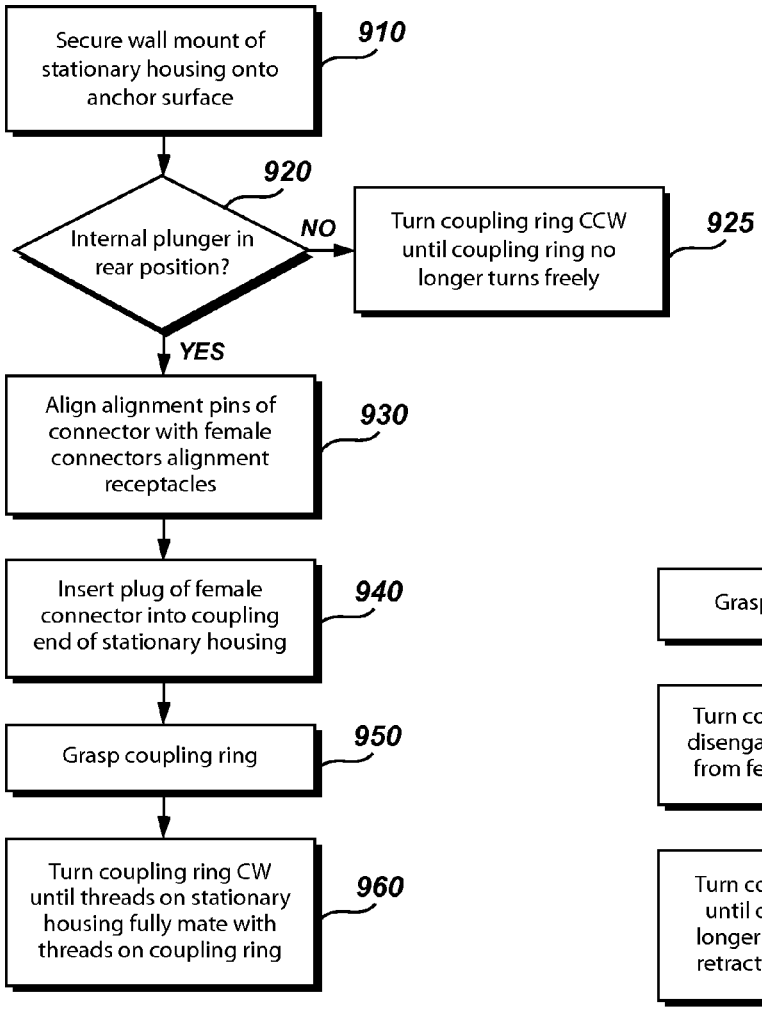
FIGS. 9A and 9B show a method of connecting and disconnecting a connector with an anchoring surface and a female connector, respectively, in accordance with an exemplary embodiment of the present invention.

FIG. 9A shows a method of connecting a connector with an anchoring surface and a female connector in accordance with an exemplary embodiment of the present invention. A user will secure the anchor mount of the stationary housing onto the anchoring surface 910. At this point the connector is mechanically secured to the anchoring surface and the stationary housing of the connector is anchored and is not free to move. The user may verify that the internal plunger is in its rear position 920. Alternatively, the user verifies that the internal plunger is in its rear position before mounting the anchor mount of the stationary housing into the missile launch rail. In accordance with an exemplary embodiment, a backward stop 520-4 catches edge 560-2 of the internal plunger, as shown in FIG. 5A. Backward stop 520-4 is a step down of the inner diameter of the stationary housing 520. Full backward stop is made when edge 560-2 of the internal plunger 560 makes contact with edge 520-4 of the stationary housing. The internal plunger 560 is moved backward 501 by counter clockwise rotation of the coupling ring 540.

Referring again to FIG. 9A, if the contact pins are not fully retracted into the stationary housing, the user retracts the pin assembly before proceeding 925. Retraction of the pin assembly is further described in the disconnection method with reference to FIG. 9B.

With the contact pins fully retracted, the user aligns alignment pins of the connector with the alignment pin receptacles of the female connector 930 and the user inserts the plug of the female connector to be tested into the coupling end of the stationary housing 930, FIG. 9A. The connector is now mechanically connected to the female connector. The user then grasps the coupling ring 950 and rotates the coupling ring clockwise until full forward translation of the internal plunger is reached and, in turn, insertion of the contact pins into the female receptacles 960 is made. Referring to FIG. 5C, full forward plunger position is achieved when the aftmost edge 520-1 of the stationary housing 520 meets front washer 543. When edge 520-1 contacts washer 543, the connector is electrically connected to the female connector for testing of the female connector itself and/or testing of the aircraft or missile launch circuit to which the female connector connects.

Figure 9B:
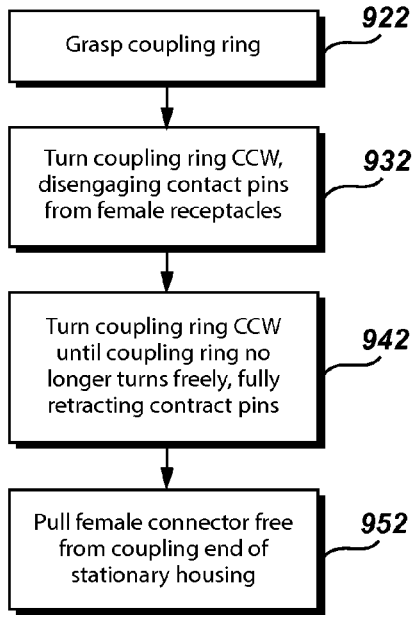

FIG. 9B shows a method of disconnecting a connector from a female connector and an anchoring surface, respectively, in accordance with an exemplary embodiment of the present invention. Once the disconnection of the connector is needed or desired, the user will grasp the coupling ring 922. The user turns the coupling ring counter-clockwise, disengaging contact pins from female receptacles 932. The users continues turning the coupling ring counter-clockwise until the coupling ring no longer turns freely, fully retracting the contact pins from the female receptacles 942. With the pins fully disengaged from the female pin receptacles, the user may pull the female connector free from coupling end of stationary housing 952. With the female plug free from the coupling end of the stationary housing, the user can now release the anchor mount of the stationary housing from the missile launch rail 962.

Referring to FIG. 5A, full retraction of the contact pins and full backward internal plunger position is achieved when edge 560-2 of the plunger catches on internal edge 520-4 of the stationary housing.

The present invention provides a means of finally controlling forward and backward movement of an internal connector plunger along its axial center. A coupling ring with an internal triple start thread rotates on an external triple start thread of a stationary housing. With the stationary housing anchored in a missile launch rail, the coupling ring is rotated clockwise, the ring pushes the non-rotating internal connector plunger forward. Forward movement can continue with clockwise rotation until the forward washer has made contact with an aft most edge of the stationary housing. In accordance with an exemplary embodiment of the present invention, the contact pins attached to the internal plunger can displace a distance of approximately 0.500 inches.

The total displacement distance of the internal plunger may be readily varied across embodiments of the present invention by increasing respective lengths of the coupling ring, stationary housing, and internal plunger. The configuration of the anchor mount of the stationary housing may also be varied in alternate embodiments to permit the secure mounting of the connector in alternate missile launcher rails. Contact pin and alignment configurations may also be varied across embodiments to accommodate alternate female connectors, perhaps on different aircraft or, again, on different missile launcher rail circuitry.

Figure 10:
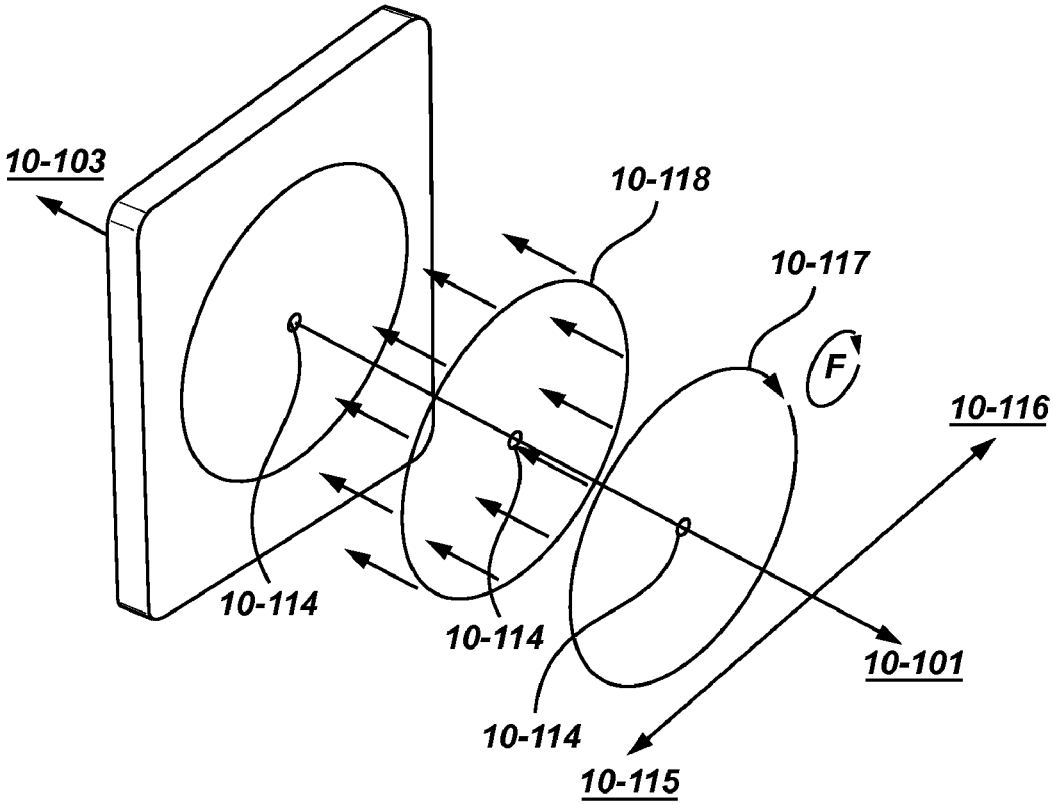
FIG. 10 shows exemplary insertion forces parallel to contact pins in accordance with exemplary embodiments of the present invention.

The triple start threads provide fine control over pin insertion into and extraction from the female plug via a hand grip about the coupling ring. Connector design translates this ring rotation about the plunger axis to a balanced circumferential force pushing the plunger forward or aft in a direction parallel to the plunger axis, and in turn, parallel to the contact pins. A left or right force 10-115, 10-116, FIG. 10, on the internal plunger may generate a moment of force on the pins, and eventual loosening or bending of the same. In accordance with the present invention, the anchored stationary housing is secured before pin insertion into a female plug markedly limiting or eliminating any off axis motion of the connector components. Further, rotational force, Fring 10-117, is translated to forward forces, Faxial 10-118, on the plunger and pins in the axial direction, 10-103.

The present invention greatly minimizes any normal forces applied to the axis of the connector. Referring to FIG. 5C, rotation of coupling ring 540 pushes an edge of the coupling ring on a front washer 543, which pushes on a circumferential edge of the plunger 560-1 and the plunger slides forward. The contact pins are parallel to the axis of the plunger and connected to the plunger, moving forward, or aft along with the plunger. Bending and stressing of contact pins is minimized when pins are aligned with respective female receptacles. The speed of insertion is readily controlled by hand rotation of the coupling ring. Any moment of inertia or contact pin to receptacle resistance is readily overcome with control using the coupling ring, in accordance with embodiments of the present invention.

Upon full forward displacement of the internal plunger, the contact pins and alignment pins are in contact with the female mating connector of the launcher rail. The rail is now ready for electrical testing. When the test is complete, the coupling ring can be rotated counter clockwise to move the internal connector plunger backward, which disengages the two connectors. Turning to FIG. 5B, when the coupling ring 540 is rotated counter clockwise, the rear washer 547 pushes backward 501 on snap ring 550 clamped around an outer circumference of an internal plunger 560. Turning to FIG. 5A, the coupling ring 540 can be rotated counter clockwise until an edge 560-2 of the connector plunger 560 stops against the rear stop of the stationary housing 520-4, ensuring that the internal connector plunger is fully disengaged. In an alternate embodiment, a pair of hash marks on the coupling ring and stationary housing, respectively, align when the internal plunger is in the full rearward position. And similarly, a second pair of hash marks on respective coupling ring and stationary housing align when the contact pins, alignment pins, and internal plunger are in the most forward position. In yet another embodiment, additional hash mark pairs can indicate interim position of connection, such as, alignment pin and/or grounding pin contact achieved.

In practice, as a user turns the coupling ring, the internal connector plunger moves forward or backward, only the coupling ring rotates, the internal connector plunger does not rotate. Rotation of the internal plunger would tangle the wires inside the connector. The internal connector plunger moves forward and backward by the force of the coupling ring against the front and rear washers, which apply force to the connector plunger. The front and rear washers facilitate slippage of the coupling ring alleviating torsion on the internal plunger.

In accordance with an exemplary embodiment of the present invention, a user may verify that the plunger is in the rear most position by visual inspection of the connector opening at the coupling end of the stationary housing, noting the relative position of the alignment pins and contact pins to the outermost edge of the coupling end. Alternatively, the user may inspect the external threads of the stationary housing for one-half inch of exposed threads. Similarly, a user may verify full forward position of the contact pins by rotating the coupling ring clockwise until the internal threads of the coupling ring mate with all the external threads of the stationary housing.

An exemplary embodiment of the present invention has been successfully connected to and disconnected from a launch circuit's female connector and a missile launcher rail compatible with an AIM-120. Contact pins were repeatedly engaged and disengaged with the subject female receptacles using the device and method of an exemplary embodiment of the present invention. The anchor mount, 122 in FIG. 1, was readily and securely mounted in the missile launcher rail, an AIM-120 rail. Exemplary connectors, in accordance with the present invention, have been successfully fit checked with a connector on an AIM-120 rail on two separate occasions. At one fit check, an exemplary connector of the present invention was unplated and for another fit check an exemplary connector in accordance with the present invention, was plated with an anodic coating, NITUFF (Nimet Industries, South Bend, Ind., USA).

An exemplary embodiment of the present invention has been successfully connected and disconnected multiple times, electrically and mechanically to an AIM-120 missile launcher rail. Its relative small size approaches that of conventional D38999 series III connectors. As shown and described, the limiting forward and aft stops provide a user assurance that contact pins are properly engaged and disengaged, respectively. Manual rotation of the coupling ring provides a user friendly means of overcoming multi-pin contact insertion and extraction forces. Likewise the rotational action in combination with triple start threads yield movement of the pin assembly that is well-controlled. Embodiments of the present invention may readily include axial and radial torque limiting and loading features.

The present invention may be a suitable substitute for many conventional male plug-type pin connectors used with conventional female socket-type pin receptacle connectors. The present invention provides a connector with a leveraging means of overcoming the insertion and extraction forces in multi-pin connections, without the need for excessive force, and without the application of a bending moment on contact pins.

Since rotation of the coupling ring provides the translation of the internal plunger, additional features could be accommodated in the present invention. A torque limiting feature could prevent excess force from being applied to any mechanical mating, such as contact pin engagement. The coupling ring could include springs and or detents that would be loaded to a desired torque and allow slippage to happen if an overload situation is encountered.

A torque load threshold feature could be accommodated with the present invention. If a threshold torque was desired before actual rotation of the coupling ring is desired, springs or detents could be incorporated into the coupling ring and stationary housing connection to ensure that a desired minimum load was achieved before the coupling ring was able to rotate. This feature may be desirable for connections in high vibration conditions.

The use of threads for axial pin plunger displacement in combination with exterior markings across the coupling ring and stationary housing can provide visual verification of contact pin position relative to female receptacles. The use of triple start threads in combination with pairs of markings across the coupling ring and the stationary housing enables the user to control and ascertain the position of contact pins relative to the female connectors. In accordance with an exemplary embodiment, it may be desirable to engage specific contacts first, perhaps ensuring grounding. For example in a linear switch application, the user may verify a first pin plunger displacement by lining up a grounding pair of hash marks. Once grounding was accomplished further rotation could be applied to engage remaining, perhaps high amperage, contact pins. Similarly, in disconnection actions, a staggered disengagement of pins is readily achieved with the fine threaded motion and hash mark pairings.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended claims and drawings.

What is claimed is:

1. An anchored male electrical connector, the connector comprising:

a stationary housing comprising:

an anchor mount;

a set of external threads on an aft end of the stationary housing;

an open coupling end on a forward end of the stationary housing;

a coupling ring connected to the stationary housing via threads, the coupling ring comprising:

a set of internal threads on a forward ring end which mate with the set of external threads on the stationary housing, engaging at least one external thread of the set of external threads on the stationary housing;

a step decrease in an internal ring diameter aft of the set of internal threads;

an internal plunger spanning a length of the connector, the plunger comprising:

a forward plunger end housed in the stationary housing;

a rear plunger end housed in the coupling ring;

contact pins in the forward plunger end;

a center plunger axis along the length of the connector;

wherein, the rear plunger end forms a rear connector end which accommodates a tester cable;

wherein the open coupling end on the forward end of the stationary housing forms a forward connector end configured to connect to a female connector of a missile launch rail for testing of the missile launch rail; and wherein the internal plunger is configured to translate forward or aft along the center plunger axis upon rotation of the coupling ring.

2. The connector according to claim 1, wherein:

the external threads of the stationary housing are triple start threads; and the internal threads of the coupling ring are triple start threads.

3. The connector according to claim 1, further comprising:

the internal plunger, further comprising:

alignment pins.

4. The connector according to claim 1, further comprising:

a front washer circumscribing the internal plunger and housed in the coupling ring.

5. The connector according to claim 1, further comprising:

a rear washer circumscribing the internal plunger and housed in the coupling ring.

6. The connector according to claim 1, further comprising:

a pair of opposing flat external surfaces along a section of the internal plunger.

7. The connector according to claim 1, further comprising:

a first external plunger diameter in the forward plunger end, a step down to a second external plunger diameter in a mid plunger span; and another step down to a third external plunger diameter in the rear plunger end.

8. The connector according to claim 1, further comprising:

the coupling ring further comprising:

a first internal threaded diameter on a forward ring end;

a step decrease to a second internal diameter aft of the first internal threaded diameter;

a step increase to a third internal diameter aft of the second diameter.

9. The connector according to claim 8, further comprising:

a front washer; circumscribing the internal plunger and housed in the coupling ring, adjacent to the step decrease to the second internal diameter of the coupling ring.

10. The connector according to claim 8, further comprising:

a rear washer, circumscribing the internal plunger and housed in the coupling ring, adjacent to the step increase to the third internal diameter of the coupling ring.

11. The connector according to claim 10, further comprising:

a snap ring clamped around the outer diameter of the internal plunger aft of and adjacent to the rear washer.

12. A method of electrically coupling an anchored male connector to a female plug, the method comprising:

securing an anchor mount of a stationary housing of the connector to an anchoring surface;

inserting the female plug into a coupling opening of a stationary housing of the connector;

grasping the connector by a coupling ring;

turning the coupling ring clockwise about the stationary housing;

pushing a front washer forward via an internal edge of the coupling ring;

pushing a circumferential edge of an internal plunger forward via the front washer; and moving contact pins connected to the internal plunger forward into pin receptacles of the female plug, which provides electrical coupling of the connector to the female plug.

13. The method of claim 12, further comprising:

mating internal threads of the coupling ring with external threads of the stationary housing during the turning of the coupling ring.

14. The method of claim 12, further comprising:

moving contact pins connected to the internal plunger forward till a forward stop is reached, which provides electrical coupling of the connector to the missile launch rail.

15. The method according to claim 14, further comprising:

aligning alignment pins connected to the internal plunger with aligning receptacles in the female plug.

16. The method according to claim 14, wherein:

the forward stop is reached when an aftmost edge of the stationary housing meets the front washer.

17. A method of uncoupling an anchored male connector from a female connector, the method comprising:

grasping a coupling ring of the connector;

retracting contact pins from pin receptacles of a female plug of the female connector by turning the coupling ring counter clockwise until reaching a rear stop;

pushing a rear washer aft via an internal edge of the turning of the coupling ring;

pushing backward on a snap ring, which is clamped around an outer circumference of an internal plunger, via the rear washer; and removing the female plug from an open coupling end of a stationary housing of the connector.

* * * * *